US008236714B2

(12) United States Patent
Frankel

(10) Patent No.: US 8,236,714 B2
(45) **Date of Patent: *Aug. 7, 2012**

(54) DYED FABRIC WITH VISIBLE AND NEAR INFRARED DIFFERENTIAL YARN FIBER SIGNATURE

(75) Inventor: Kevin A. Frankel, Hockessin, DE (US)

(73) Assignee: Invista North America S.à.r.l., Wilmington, DE (US)

( * ) Notice: Subject to any disclaimer, the term of this patent is extended or adjusted under 35 U.S.C. 154(b) by 1197 days.

This patent is subject to a terminal disclaimer.

(21) Appl. No.: 11/301,608

(22) Filed: Dec. 13, 2005

(65) Prior Publication Data

US 2008/0102724 A1 May 1, 2008

(51) Int. Cl.
*D03D 15/00* (2006.01)
*D04B 1/00* (2006.01)

(52) U.S. Cl. ..... 442/301; 442/289; 442/306; 442/308; 428/15; 428/88; 428/196; 428/364; 428/400; 8/481; 8/483; 8/494; 2/69; 2/84; 2/94

(58) Field of Classification Search ..... 2/108, 69, 2/85, 900, 93; 8/400, 483, 478, 506, 510, 8/550, 552, 618, 648, 657, 907, 923, 927; 428/102, 159, 180, 190, 195.1, 207, 310.5, 428/49, 913, 919, 364, 400, 289, 17, 99, 428/132, 136; 442/289, 208–220, 131–133, 442/301, 302, 920, 921, 199, 198, 306, 308; 524/417, 435, 496, 605; 139/420 R
See application file for complete search history.

(56) References Cited

U.S. PATENT DOCUMENTS 3,700,397 A * 10/1972 Ramsley et al. ..... 8/506
3,701,164 A * 10/1972 Blore ..... 2/409
(Continued)

FOREIGN PATENT DOCUMENTS

JP 08291438 A * 11/1996

OTHER PUBLICATIONS

Kadolph, Sara J. and Anna Langford. Textiles. 8th edition. Upper Saddle River, NJ: Prentice-Hall, 1998. pp. 175-184 and 216-225.*

(Continued)

*Primary Examiner* — Elizabeth Cole
*Assistant Examiner* — Altrev Sykes
(74) *Attorney, Agent, or Firm* — Christina W. Geerlof

(57) ABSTRACT

A fabric having a camouflage appearance in the near infrared (NIR) spectrum with a substantially a single color appearance in the visible (VIS) spectrum is provided. The novel fabric may include at least two synthetic polymer multifilament yarns. The multifilament yarns are selected from 3 types of multifilament yarns: multifilaments comprising carbon black, multifilaments comprising pigments which modify the NIR reflectance characteristics of the multifilaments, and multifilaments substantially free of additives capable of modifying the NIR reflectance characteristics of the multifilaments. The fabric is dyed to a substantially single color appearance in the visible spectrum. In general, the fabric has a NIR spectrum comprising two reflectance curves having about 10% to about 85% reflectance separated by about 5% reflectance in a range of wavelengths from about 700 to about 860 nanometers (nm).

The fabric may be used to manufacture garments, equipment, tents and tarpaulins that exhibit a camouflage appearance in NIR reflectance observed using night vision devices. At the same time, these garments, equipment, tents and tarpaulins have a single color and substantially non-camouflage in the VIS reflectance spectrum.

11 Claims, 8 Drawing Sheets

U.S. PATENT DOCUMENTS

| | | | | |
|---|---|---|---|---|
| 4,064,305 | A * | 12/1977 | Wallin | 442/308 |
| 4,095,940 | A * | 6/1978 | Weingarten | 8/483 |
| 4,408,004 | A * | 10/1983 | Pengilly | 524/398 |
| 4,529,633 | A * | 7/1985 | Karlsson | 428/17 |
| 4,659,602 | A * | 4/1987 | Birch | 428/88 |
| 4,671,988 | A * | 6/1987 | Dowell et al. | 442/306 |
| 4,767,649 | A * | 8/1988 | Birch | 428/99 |
| 5,798,304 | A * | 8/1998 | Clarkson | 442/289 |
| 6,061,828 | A * | 5/2000 | Josephs | 2/69 |
| 6,805,957 | B1 * | 10/2004 | Santos et al. | 428/400 |
| 6,933,023 | B2 * | 8/2005 | Clausen et al. | 428/17 |
| 7,008,694 | B1 * | 3/2006 | Frankel | 428/364 |
| 7,156,883 | B2 * | 1/2007 | Lovasic et al. | 8/115.51 |
| 2005/0176323 | A1 * | 8/2005 | Minato et al. | 442/185 |
| 2006/0234050 | A1 * | 10/2006 | Frankel | 428/364 |

OTHER PUBLICATIONS

Cox, Randy. (2000) Camouflage Infosheet. http://web.archive.org/web/20001007184758/http://www.warpig.com/paintball/technical/camouflage/camo.shtml.pp. 1-3.*

Near IR, http://mvh.sr.unh.edu/mvhtools/near_ir.htm.*

U.S. Appl. No. 11/108,021, filed Apr. 15, 2005, Kevin A. Frankel.

* cited by examiner

DYED FABRIC WITH VISIBLE AND NEAR INFRARED DIFFERENTIAL YARN FIBER SIGNATURE

FIELD OF THE INVENTION

The present invention relates to an innovative fabric, woven or knitted from synthetic polymer yarns, having a single color appearance in the visible (VIS) range of the spectrum and a camouflage appearance in the near infrared (NIR) of the spectrum. More particularly, the individual synthetic yarns comprising the fabric include at least two types selected from: synthetic fibers containing carbon black, synthetic fibers containing pigments which modify the NIR reflectance signature, and synthetic fibers substantially free of modifying agents. In addition, the innovative fabric is advantageously dyed with conventional dyes to a single uniformly colored appearance in the visible spectrum. Garments from the fabrics of the invention provide a camouflage effect in the NIR which substantially conceal the wearer from observation using "night vision devices."

BACKGROUND OF THE INVENTION

Continuing efforts exist to make fabrics that will be converted into garments (also referred to as equipment), e.g. jackets, rucksacks, ballistic vests, and boots, which are substantially invisible (camouflaged) in near infrared (NIR) wavelengths. Such equipment may also include tents, tarpaulins and sleeping bag outer fabric. In order to achieve the goal of NIR camouflage, the fabric, garment or equipment must closely match the NIR signature of the surroundings. Each terrain element has a different reflective signature based on its chemical make-up. For example, foliage (a major component of woodland environments) has a relatively low reflectance in the visible region and a relatively high reflectance in the NIR region. In contrast, sand, a major component of desert environments, and concrete, a major component of urban environments, have a relatively high reflectance in the visible region and a low reflectance in the NIR region. It is known to the skilled person that synthetic polymer polyamide and polyester fibers are very reflective in the 400-2000 nanometer (nm) range. As a result, it is desirable to reduce NIR reflectance of polyamide and polyester garments and equipment to more closely match the NIR reflectance of their environment. Such a NIR reflectance modification renders garments and equipment substantially concealed, and in turn the wearer, not revealed by the use of night vision devices, such as night vision goggles or image intensified converters.

It is desirable for use, especially by some armed forces, to have a solid color in the visible (VIS) region of the spectrum for particular parts of equipment and uniforms to match the sections having camouflage prints or a civilian appearance. At the same time there is a desire to have the solid color have a pattern in the NIR region. Useful fabrics for equipment and uniforms can be made entirely of synthetic polyamide or polyester or of blends of these synthetics with cotton. Thus there is a need for a fabric that is solid color in the visual region while a broken pattern in the NIR region.

The Applicant describes textile yarns having a modified NIR signature useful for protecting the wearer from being revealed by night vision devices in U.S. patent application Ser. No. 11/108,021 (filed Apr. 15, 2005); now issued as U.S. Pat. No. 7,008,694; the disclosure of which is incorporated herein in its entirety by reference. In addition, known methods to reduce infrared (IR) reflectance of fabrics use IR absorbing pigments in combination with the fabric. For example, U.S. Pat. No. 5,798,304 to Clarkson ("Clarkson"), the disclosure of which is hereby incorporated by reference, discloses that carbon black pigment absorbs light in the IR range 1000 to 1200 nm. Clarkson discloses a fabric that comprises a camouflage pattern, where the camouflage pattern is visible in the IR region but is invisible in the visible region. The fabric may be printed with a non-camouflage pattern that is visible in the visible region of the spectrum. To achieve this goal, Clarkson prints the fabric with an IR-absorbing material, such as carbon black, a chitin resin or other IR-absorbing pigment. Clarkson discloses that the IR-reflectivity of the fabrics is arranged to match that of the surroundings in which it is to be used. For example, Clarkson discloses that for temperate foliage overall IR reflectivity is typically required to be 35%, which may rise to 70% for desert regions. To achieve the desired overall reflectivity, the camouflage pattern comprises at least two areas of different IR-reflectivity which differ from one another by at least 5%. The IR-camouflage pattern is generally printed onto the fabric after the fabric has been dyed according to the Clarkson disclosure.

SUMMARY OF THE INVENTION

The invention includes fabrics (for example, knit or woven fabrics) with modified NIR signatures susceptible to dyeing to a single color. The fabrics provided according to the following disclosure are useful for equipment and garments having a camouflage pattern in the NIR. Garments and equipment from these fabrics are capable of breaking up the wearer's silhouette, as viewed in the NIR spectral range, and provide enhanced concealment to the wearer against night vision observation devices.

Herein provided is a fabric having a camouflage appearance in the near infrared (NIR) spectrum and having substantially a single color appearance in the visible (VIS) spectrum. The novel fabric comprises at least two synthetic polymer multifilament yarns. The two multifilament yarns can be selected from the group consisting of 3 types of multifilament yarns: multifilaments comprising carbon black, multifilaments comprising pigments which modify the NIR reflectance characteristics of the multifilaments, and multifilaments substantially free of additives capable of modifying the NIR reflectance characteristics of the multifilaments.

Another embodiment of the fabric includes a fabric having a substantially single color appearance in the visible spectrum provided by a dye. In another embodiment, the fabric has a NIR spectrum comprising two reflectance curves having about 10% to about 85% reflectance and the two reflectance curves are separated by about 5% reflectance in a range of wavelengths from about 700 to about 860 nanometers (nm).

In another embodiment, the fabric has a NIR spectrum comprising three reflectance curves having about 25% to about 75% reflectance and wherein three reflectance curves are separated by about 5% reflectance in a range of wavelengths from about 700 to about 860 nanometers (nm).

In another embodiment, the fabric comprises a woven fabric having a warp and a fill direction wherein the at least two synthetic polymer multifilament yarns comprise the warp direction and the fill direction.

In another embodiment, the fabric comprises a knit fabric having a course row of loops and wale column of loops wherein the at least two synthetic polymer multifilament yarns comprise the course row of loops and the wale column of loops.

In another embodiment, the fabric can be comprised of at least two synthetic polymer multifilament yarns comprising synthetic polymers selected from the group consisting of polyamides and polyesters.

In another embodiment, the fabric can be comprised of at least two synthetic and natural fiber blends (e.g. polyamides/cotton and polyester/cotton) selected from the group.

In another embodiment, the substantially single color appearance in the visible spectrum of the fabric is provided by a dye applied to the synthetic polymer multifilament yarns prior to fabric formation. For example, the individual yarn packages are dyed prior to a weaving or knitting process to make the fabric.

The invention may include a process for rendering to a fabric a camouflage appearance in the near infrared (NIR) spectrum while retaining a substantially a single color appearance in the visible (VIS) spectrum. The method comprises the steps of: providing to a fabric forming means at least two synthetic polymer multifilament yarns selected from the group consisting of: first multifilaments comprising carbon black, second multifilaments comprising pigments which modify a NIR reflectance characteristic of said second multifilaments, and third multifilaments substantially free of additives capable of modifying the NIR reflectance characteristics of said third multifilaments; forming a fabric having a predetermined pattern of said pattern of first, second and third multifilament yarns; and dyeing the fabric to a single color. Fabrics formed in this manner are useful in the construction of garments and equipment within the scope of the invention.

BRIEF DESCRIPTIONS OF THE DRAWINGS

DETAILED DESCRIPTION

Figure 1:
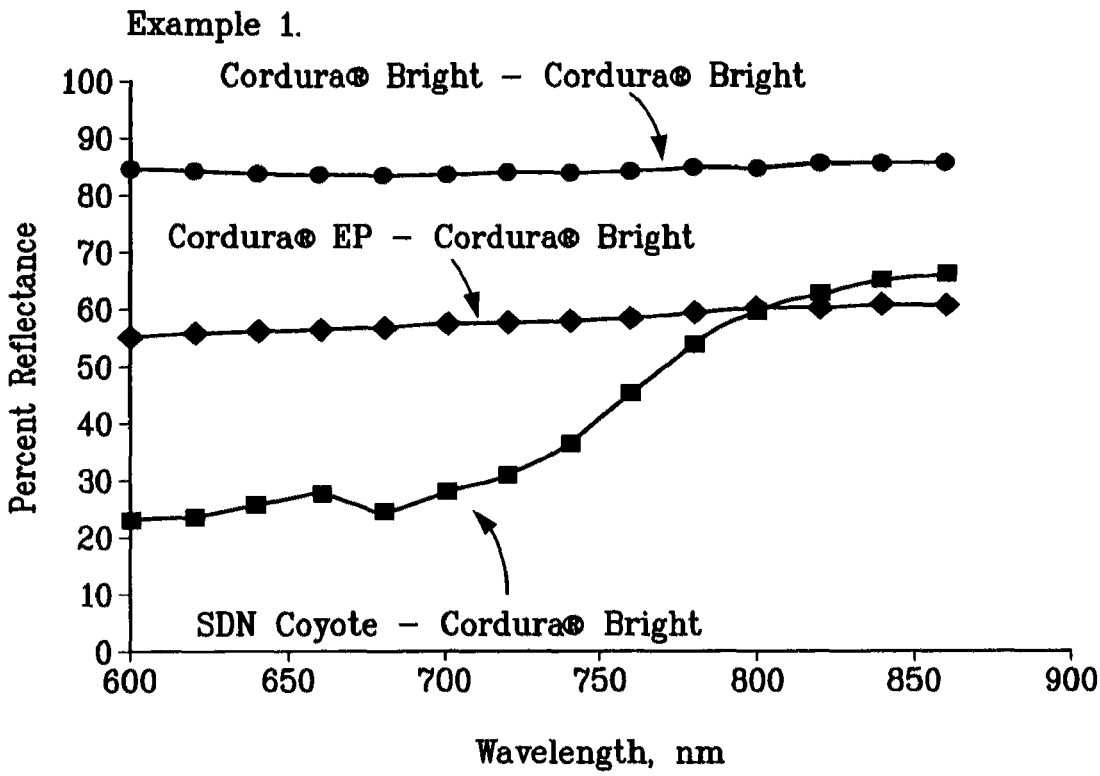
FIG. 1 is a graphical representation of a undyed fabric containing a polyamide yarn with no additives, a polyamide yarn with carbon black, and a polyamide yarn with various pigments in the warp direction and a polyamide yarn with no additives in the fill direction; showing the NIR reflectance of this fabric in the range of 600 to 900 nanometers.
Figure 2:
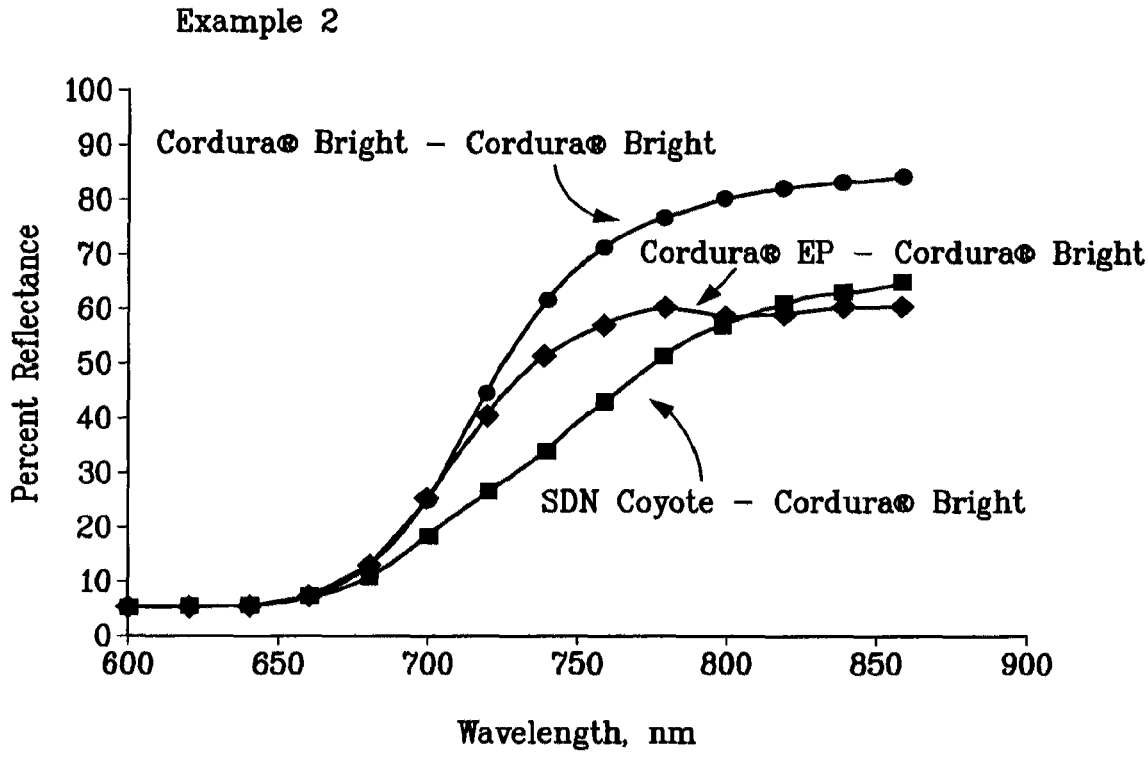
FIG. 2 is a graphical representation of a fabric dyed brown with acid dyes containing standard a polyamide yarn with no additives, a polyamide yarn with carbon black, and a polyamide yarn with various pigments in the warp direction and a polyamide yarn with no additives in the fill direction; showing the NIR reflectance of this fabric in the range of 600 to 900 nanometers.

The fabrics provided herein are useful for equipment and garments and provide a camouflage pattern as viewed in the infrared and a single color appearance as viewed in the VIS. Since the garments and equipment from these fabrics break up the wearer's silhouette, as viewed in the infrared spectral range, enhanced concealment to the wearer against night vision observation devices is provided. These fabrics may be formed by any conventional means of weaving and knitting processes. In the case of fabric formation by weaving substantially any warp and weft combination construction is possible. In the case of fabric formation by knitting substantially any loop course and wale construction is possible.

The woven or knitted fabric can be formed from synthetic polymer multifilament yarns comprised of polyamides. Suitable polyamides include nylon 66, nylon 6, nylon 7, nylon 610, nylon 612 and copolyamides. In general, these polyamide polymers are inherently dyeable with acid type dyes. Acid dye receptivity of these polyamides may be modified using known deep dyeing additives which provide addition amine end groups. Optionally, it is possible to make these polyamide polymers susceptible to staining with cationic dyes through known modifications to the polymer. Cationic dye modifiers for use with polyamides include for example aromatic dicarboxylic acids substituted with one or more sulfonyl groups, especially 5-sulfo-isophthalic acid.

The woven or knitted fabric can be formed from synthetic polymer multifilament yarns comprised of polyester synthetic polymers. Suitable polyesters include polyethylene terephthalate, polypropylene terephthalate, polybutylene terephthalate and copolyesters. These polyester polymers are dyeable using disperse dyes known in the art. Optionally, these polyester polymers may include additives to make the polyester susceptible to dyeing with cationic dyes. Such additives include aromatic dicarboxylic acids substituted with one or more sulfonyl groups, especially 5-sulfo-isophthalic acid.

The woven or knitted fabrics according to the invention can be formed from synthetic polymer multifilament yarns comprised of mixtures of such yarns with natural fibers. Suitable natural fibers include cotton, cellulosic fibers or regenerated cellulosic fibers. Dyeing methods known in the art can be used to provide useful dye shades in the visible spectrum to such combination yarns in the form of fabrics according to the invention. For example, it is known to apply fiber reactive vinyl sulfone or VAT dyes with polyamide and cotton blends. Similarly, the use of VAT dyes and disperse dyes are within the knowledge of the skilled person for use with polyester and cotton blends.

The fabric may be advantageously dyed in any conventional manner to a single uniform color. Optionally, the fabric may be formed from synthetic polymer multifilament yarns or blends with cotton yarns all of which are yarn dyed prior to fabric formation. For example, the process of yarn package dyeing, known to the skilled person, is an efficient means for yarn dyeing.

A fabric of the invention may be formed from a portion of either polyamide or polyester synthetic polymer multifilament yarns which are modified to provide different visible (VIS) and infrared reflectance signatures. Accordingly, the fabric of the invention is formed from synthetic polymer multifilament yarns of at least two, and more typically, of three types of yarn; each type having different visible (VIS) and infrared reflectance signatures. There is no fundamental limit to the number of yarn types in a single fabric of the invention. At least two multifilament yarns are selected from the group consisting of: multifilament yarns containing carbon black in an amount from about 10 parts per million to about 300 parts per million, multifilaments comprising pigments which modify the NIR reflectance characteristics of the multifilaments, and multifilaments substantially free of additives capable of modifying the NIR reflectance characteristics of the multifilaments.

A fabric of the invention, formed from at least two types of modified multifilament yarns is advantageously dyed to a single color in a conventional manner. In general, the fabric has a NIR reflectance signature in the range of 700 to 900 nanometers (nm) substantially unchanged from the fabric before dyeing. As a result, the appearance of the dyed fabric is that of a single substantially uniform color in the VIS spectrum (400-680 nm) while having patterned appearance in the near infrared region (700-900 nm) due to the different NIR reflectivities of the component yarns.

A polyamide based fabric of the invention can be prepared which includes three types of polyamide multifilament yarns in the following way. Three polyamide yarns are selected and woven into a fabric. The polyamide multifilament yarns can be for example: (i) Nylon 66 Cordura® EP yarn containing carbon black, (ii) a standard Nylon 66 Cordura® yarn, and (iii) a solution dyed Cordura® Coyote yarn containing various pigments material (Cordura® brand yarns are available from INVISTA S.àr.l., Wilmington, Del. 19808). Each of the yarns i.-iii., having a different VIS spectral and a different NIR spectral reflectance characteristic, is woven separately into the fabric as both a warp yarn and a fill yarn. The weaving pattern is freely selectable among those patterns known to the skilled person. Weaving patterns which provide bands of yarns of substantially the same width in a parallel configuration or crossing at a right angle readily exemplify the objects of the invention. After weaving the fabric is prepared for dyeing and dyed with an acid dye in a known manner to a single substantially uniform color. Prior to dyeing the fabric appearance is multi-colored in the VIS spectrum. For example, a plaid appearance is easily obtained before dyeing, represented by the fabric 10 of FIG. 7. By contrast, the dyed fabric has a single color in the VIS spectrum, represented by the fabric 20 of FIG. 8, and a plaid pattern in the NIR reflectance spectrum.

The fabric woven from the same three yarns i.-iii. above may be patterned to be representative of the background NIR reflectance of any terrain or environment. Garments fabricated from such background terrain patterned fabrics which are dyed to a single color in the VIS spectrum will provide a substantially enhanced level of concealment to the wearer of the garment observed by means of night vision devices sensitive in the spectral region of about 700 nm to about 900 nm. In general, the garments and equipment from the fabrics of the invention are superior performing to conventional camouflage fabrics worn for concealment purposes when viewed using enhanced optical imaging devices such as night vision goggles.

Test Methods

All visible and near infrared (VIS-NIR) spectra measurements throughout this disclosure were made using a CARY 5000® spectrometer from Varian, Inc. with Corporate Headquarters located at 3120 Hansen Way, Palo Alto, Calif. 94304-1030, USA, (Telephone: 650.213.8000.) A diffuse reflectance accessory was employed to measure the reflectance curves in the 600 to 900 nm range. Fabric samples were mounted to avoid the background contribution to the NIR reflection measured.

EXAMPLES

Woven fabrics of the invention were prepared in the following examples using three polyamide fibers in the weave warp direction and up to three polyamide fiber in the weave fill direction. In one embodiment, the invention can provide an effective camouflage pattern with a minimum of 2 multifilament yarns having different NIR signatures in the fabric warp and two multifilament yarns of different NIR signatures in the fill (weft) direction.

A conventional weaving technique was used to make the fabric examples of the invention. The fabric was constructed by first making a warp of yarns using a conventional single end warper and then woven on a conventional air jet loom. The fabric contained 55 yarn ends in the warp direction and 40 pick yarns in the fill direction. In this example, the polyamide multifilament yarns in the warp direction were: a pigmented yarn known as SDN Cordura® Coyote, Cordura® EP (containing a small amount of carbon black from AMERICHEM INC. PRODUCT 11793-F1), and a Cordura® "bright" containing no additives. The SDN Cordura® Coyote fiber was prepared by compounding blue, yellow, and red pigments (supplied by AMERICHEM INC) into the polymer.

Table 1 shows eight example fabrics. Fabric examples 1 and 2 contained in the fill direction the polyamide yarn called Cordura® Bright. Invention fabric examples 3 and 4 contained in the fill direction the polyamide yarn called SDN Cordura® Coyote. Invention fabric examples 5 and 6 contained in the fill direction the polyamide yarn called Cordura® EP. Whereas, invention examples 7 and 8 were fabrics containing all three fibers, Cordura® EP, SDN Cordura® Coyote and Cordura® Bright, in both the warp and fill directions.

TABLE 1

| | Warp yarn 1 | Warp yarn 2 | Warp yarn 3 | Weft yarn 1 | Weft yarn 2 | Weft yarn 3 |
|---|---|---|---|---|---|---|
| Ex. 1 | CORDURA ® BRIGHT | CORDURA ® EP | CORDURA ® SDN Coyote | CORDURA ® BRIGHT | . . . | . . . |
| Ex. 2 dyed | CORDURA ® BRIGHT | CORDURA ® EP | CORDURA ® SDN Coyote | CORDURA ® BRIGHT | . . . | . . . |

TABLE 1-continued

| | Warp yarn 1 | Warp yarn 2 | Warp yarn 3 | Weft yarn 1 | Weft yarn 2 | Weft yarn 3 |
|---|---|---|---|---|---|---|
| Ex. 3 | CORDURA ® BRIGHT | CORDURA ® EP | CORDURA ® SDN Coyote | . . . | . . . | CORDURA ® SDN Coyote |
| Ex. 4 dyed | CORDURA ® BRIGHT | CORDURA ® EP | CORDURA ® SDN Coyote | . . . | . . . | CORDURA ® SDN Coyote |
| Ex. 5 | CORDURA ® BRIGHT | CORDURA ® EP | CORDURA ® SDN Coyote | . . . | CORDURA ® EP | . . . |
| Ex. 6 dyed | CORDURA ® BRIGHT | CORDURA ® EP | CORDURA ® SDN Coyote | . . . | CORDURA ® EP | . . . |
| Ex. 7 | CORDURA ® BRIGHT | CORDURA ® EP | CORDURA ® SDN Coyote | CORDURA ® BRIGHT | CORDURA ® EP | CORDURA ® SDN Coyote |
| Ex. 8 dyed | CORDURA ® BRIGHT | CORDURA ® EP | CORDURA ® SDN Coyote | CORDURA ® BRIGHT | CORDURA ® EP | CORDURA ® SDN Coyote |

Figure 3:
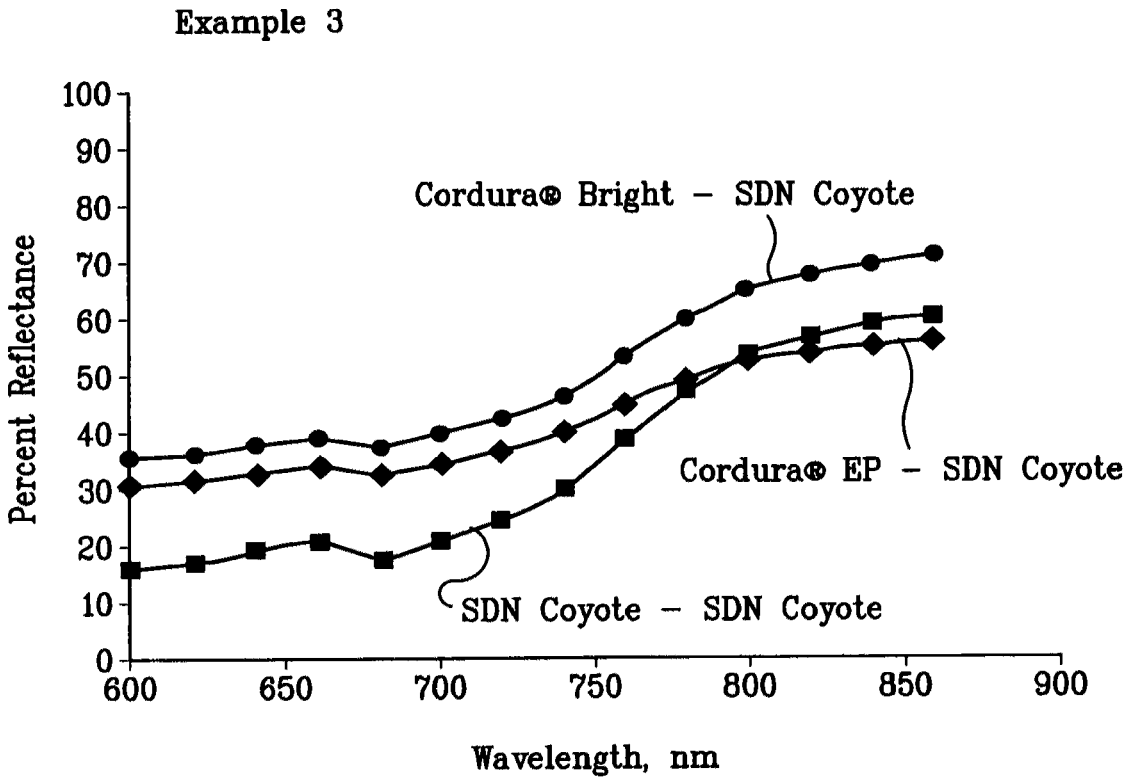
FIG. 3 is a graphical representation of a undyed fabric containing standard a polyamide yarn with no additives, a polyamide yarn with carbon black, and a polyamide yarn with various pigments in the warp direction and a polyamide yarn with various pigments in the fill direction; showing the NIR reflectance of this fabric in the range of 600 to 900 nanometers.
Figure 5:
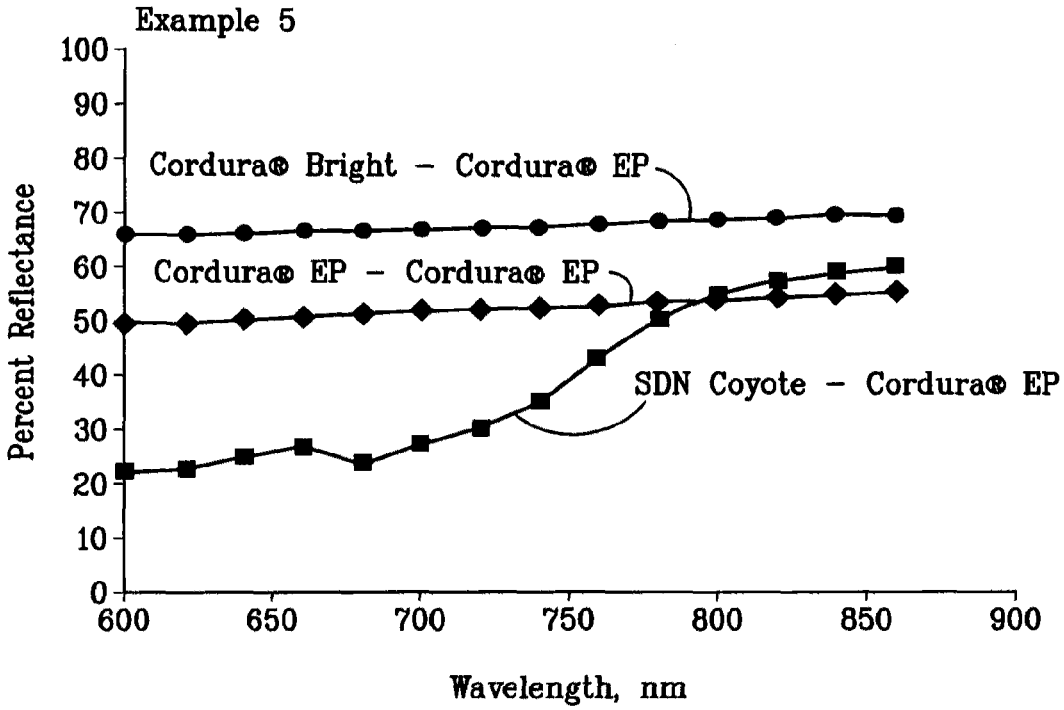
FIG. 5 is a graphical representation of an undyed fabric containing standard a polyamide yarn with no additives, a polyamide yarn with carbon black, and a polyamide yarn with various pigments in the warp direction and a polyamide yarn with carbon black in the fill/weft direction; showing the NIR reflectance of this fabric in the range of 600 to 900 nanometers.
Figure 7:
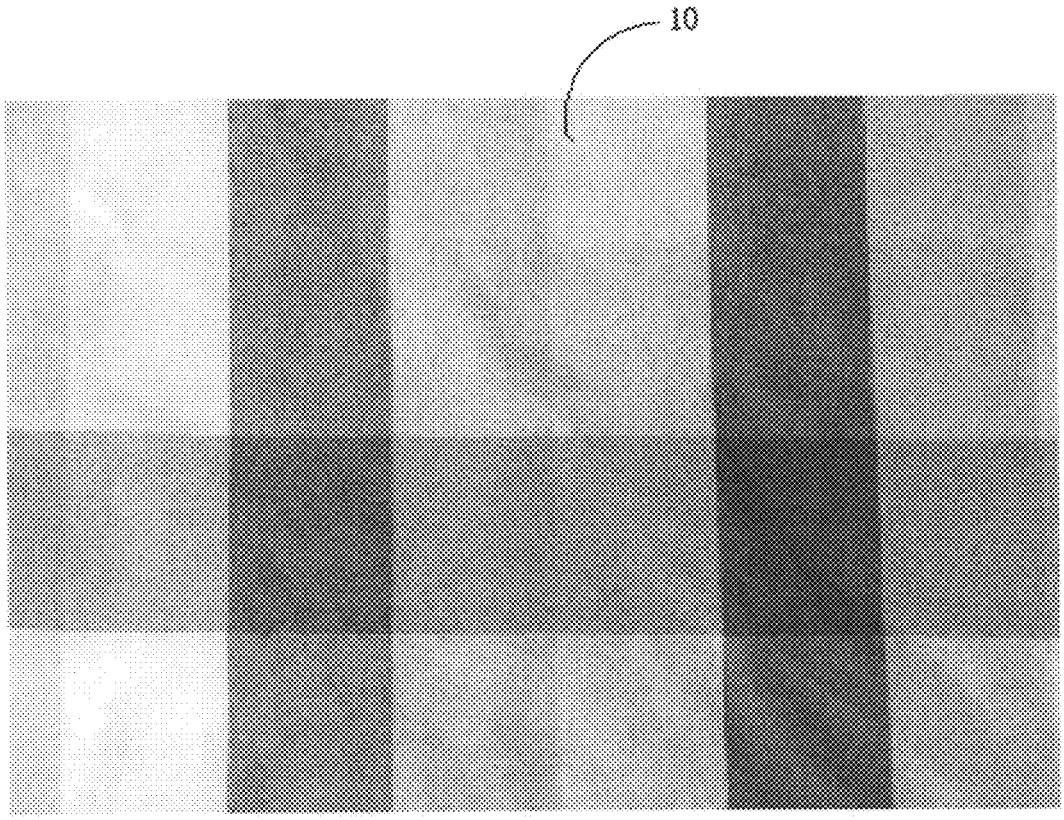
FIG. 7 is a photo representation of an undyed fabric containing standard a polyamide yarn with no additives, a polyamide yarn with carbon black, and a polyamide yarn with various pigments in the warp and weft (or fill) directions.

FIG. 7 is a photo representation of a Fabric 10 combining all the features of the Example 1, 3 and 5. The Fabric 10, contains Cordura® Bright, Cordura® EP, and SDN Cordura® Coyote in the warp direction and Cordura® Bright, Cordura® EP, and SDN Cordura® Coyote in the fill direction. Woven Fabric 10 displays in the VIS spectrum various portions each comprised of warp and weft yarns crossing each other at a right angle. Each of these various portions has a unique NIR reflectance spectrum. The 9 distinct NIR reflectance curves in a range of 600 to 900 nanometers represented in FIGS. 1, 3 and 5 are displayed in Fabric 10. These 9 distinct curves provide sufficient contrast in the NIR to make the fabric useful in camouflage applications when viewing using night vision devices. For example, in FIG. 1, the yarns having no additive, Cordura® Bright, in the warp and fill directions reflect approximately 84 to 86% of the wavelength between 600 and 860 nm. The yarns containing carbon black, Cordura® EP, in the warp direction and having no additive (Example 1) Cordura® Bright, in the fill direction reflect approximately 55 to 61% of the wavelength between 600 and 860 nm. The SDN Cordura® COYOTE yarns in the warp direction and the yarns having no additive (Example 1), Cordura® Bright, in the fill direction reflects between 20 and 28% over the 600 to 700 nm range, 28%-60% over the 700 nm to 800 nm range and 60-67% over the range 800-860 nm.

Figure 8:
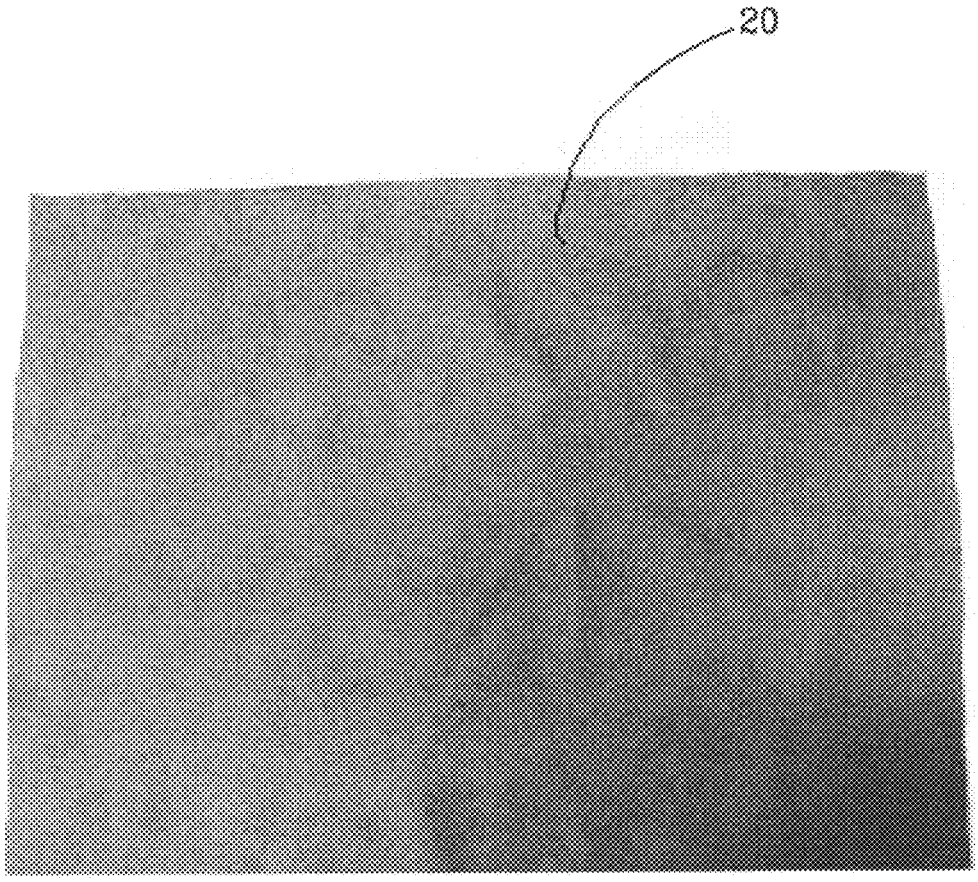
FIG. 8 is a photo representation of a dyed fabric containing standard a polyamide yarn with no additives, a polyamide yarn with carbon black, and a polyamide yarn with various pigments in the warp and weft (or fill) directions.

FIG. 8 is a photo representation of a Fabric 20 prepared from the Fabric 10 of FIG. 9 and dyed brown. The fabric was dyed using a conventional jig dyer and acid dyes for nylon. The dying procedure is the following. The fabric was first scoured to remove all contaminants from the fiber producing and weaving process. The fabric was then rinsed at 54° C. (130° F.) and 71° C. (160° F.). Acid leveling dyes were applied at a pH of 6.0 and the temperature was raised to 100° C. (212° F.). The fabric was dyed for 45 minutes and then allowed to cool. After dyeing, the fabric was dried on a conventional tenter frame at 121° C. (250° F.). FIG. 8 is a photo representation of a fabric embodying all the features of Examples 2, 4 and 6. FIG. 8 displays nine distinct NIR reflectance curves in a range from 700 to 900 nanometers. The yarn having no additive fiber in the warp direction and fill direction (Example 2) reflects between 5 and 25% over the 600 to 700 nm range, 25%-80% over the 700 nm to 800 nm range and 80-83% over the range 800-860 nm. The yarn containing carbon black in the warp direction and yarns having no additive fiber in the fill direction (Example 2) reflect between 5 and 25% over the 600 to 700 nm range, 25%-58% over the 700 nm to 800 nm range and 58-60% over the range 800-860 nm. The SDN Cordura® COYOTE yarn in the warp direction and yarn having no additive fiber in the fill direction (Example 2) reflect between 5 and 20% over the 600 to 700 nm range, 20%-50% over the 700 nm to 800 nm range and 50-65% over the range 800-860 nm. The reflectance curves between 600 and 700 nm are almost identical. These similarities between the curves are due to their VIS color and essentially identical VIS reflectance curves. Beyond 700 nm and into the NIR their reflectance curves are distinct. Therefore a pattern is observable in the NIR using a night vision device.

FIG. 3 is a graphical representation of an undyed fabric containing the yarns described for Example 3 in Table 1. FIG. 3 shows the NIR reflectance of this fabric in the range of 600 to 900 nanometers and having 3 distinct reflection curves. The Example 3 fabric provides a night vision device observable separation among the regions formed from the component warp and weft yarns. For example, the no additive yarn in the warp direction and the SDN Cordura® Coyote yarn in the fill direction reflects between 35 and 40% over the 600 to 700 nm range, 40%-65% over the 700 nm to 800 nm range and 65-72% over the range 800-860 nm. The yarn containing carbon black in the warp direction and the SDN Cordura® Coyote yarn in the fill direction exhibits between 31 and 33% reflectance over the 600 to 700 nm range, 33%-50% over the 700 nm to 800 nm range and 50-57% over the range 800-860 nm. The SDN Cordura® Coyote yarn in the warp direction and no additive yarn in the fill direction reflect between 15 and 20% over the 600 to 700 nm range, 20%-50% over the 700 nm to 800 nm range and 50-61% over the range 800-860 nm.

Figure 4:
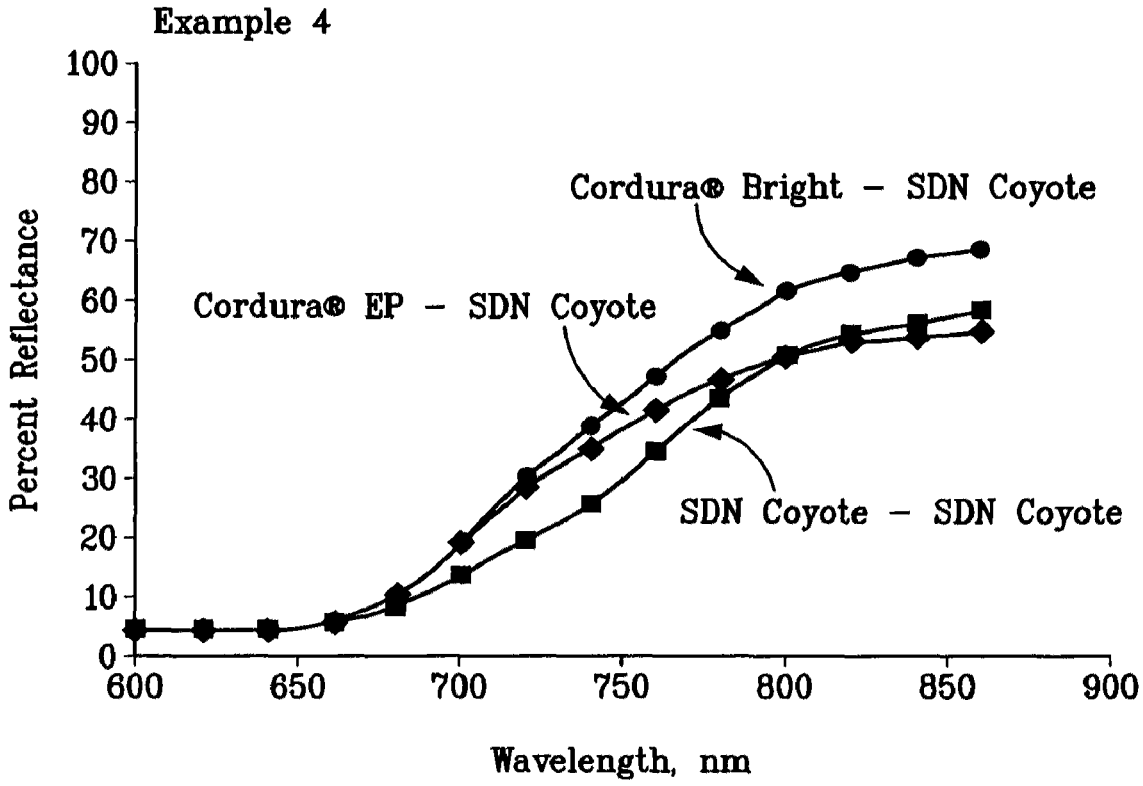
FIG. 4 is a graphical representation of a fabric dyed brown with acid dyes containing standard a polyamide yarn with no additives, a polyamide yarn with carbon black, and A polyamide yarn with various pigments in the warp direction and a polyamide yarn with various pigments in the fill direction; showing the NIR reflectance of this fabric in the range of 600 to 900 nanometers.

FIG. 4 is a graphical representation of the same fabric in FIG. 3 with the exception the fabric is dyed brown (Example 4). The fabric was dyed and dried in the same manner as previously discussed. FIG. 4 shows the NIR reflectance of this fabric in the range of 600 to 900 nanometers. This Example 4 fabric exhibits 3 distinct reflection curves providing a night vision device observable separation of the various fabric regions. The Example 4 woven fabric shows in the region where the no additive yarn in the warp direction and SDN Cordura® weft yarns cross, a reflection between 4 and 20% over the 600 to 700 nm range, 20%-55% over the 700 nm to 800 nm range and 55-68% over the range 800-860 nm. The yarn containing carbon black in the warp direction and Coyote fiber in the weft direction reflect between 5 and 20% over the 600 to 700 nm range, 20%-46% over the 700 nm to 800 nm range and 46-55% over the range 800-860 nm. The SDN Cordura® COYOTE yarn in the warp direction and SDN Cordura® COYOTE yarn in the weft direction reflect between 5 and 15% over the 600 to 700 nm range, 15%-45% over the 700 nm to 800 nm range and 45-58% over the range 800-860 nm. Note the reflectance curves between 600 and 700 nm are almost identical. The similarities of these curves occur because the VIS color is the essentially the same with the same reflectance curve. Beyond 700 nm the reflectance curves separate providing a distinct pattern observable with night vision devices FIG. 5 is a graphical representation of an un-dyed fabric containing the yarns described for Example 5 in Table 1. FIG. 5 shows the NIR reflectance of this Example 5 fabric in the range of 600 to 900 nanometers as having 3 distinct reflection curves. As a result, these 3 distinct curves provide an observable separation of the various regions of the fabric viewed with the aid of an image enhancement device, e.g. night vision goggles. The no additive yarn in the warp direction and the yarn containing carbon black in the fill direction of Example 5 reflects between 65 and 70% over the 600 to 860 nm range. The yarn containing carbon black in the warp direction and fill direction reflects between 50 and 55% over the 600-860 nm. The SDN Cordura® COYOTE fiber in the warp direction and the fiber containing carbon black in the fill direction reflect between 20 and 27% over the 600 to 700 nm range, 27%-55% over the 700 nm to 800 nm range and 55-60% over the range 800-860 nm.

Figure 6:
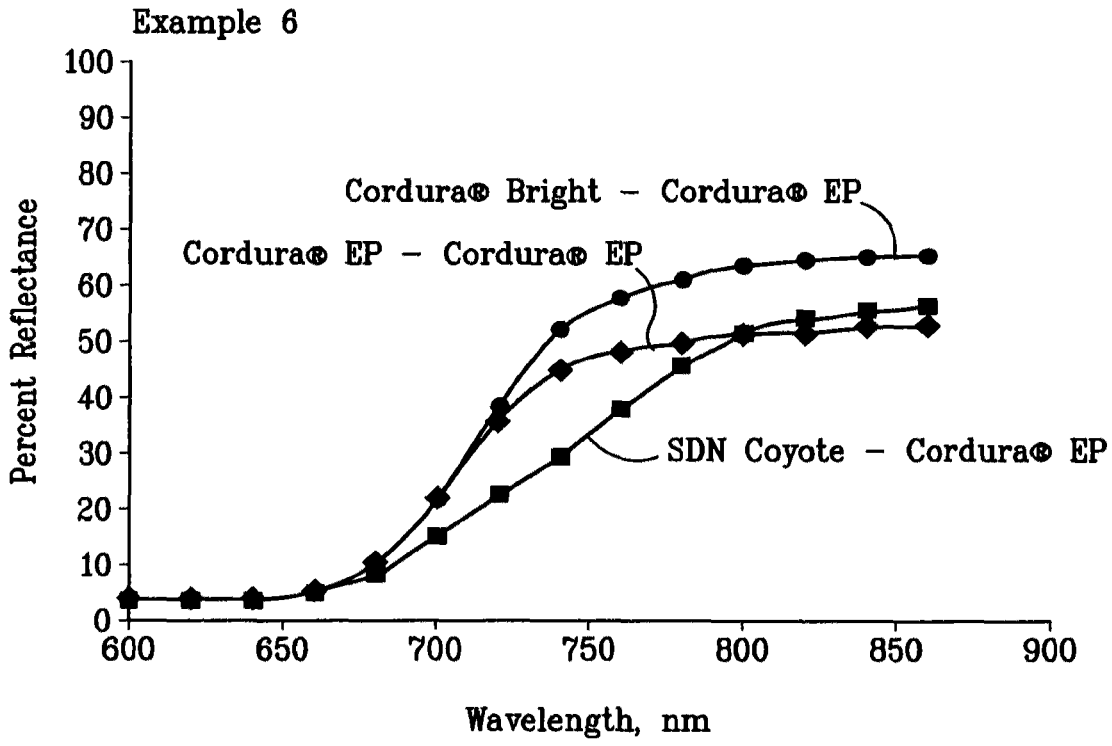
FIG. 6 is a graphical representation of a fabric dyed brown with acid dyes containing a polyamide yarn with no additives, a polyamide yarn with carbon black, and a polyamide yarn with various pigments in the warp direction and a polyamide yarn with carbon black in the fill/weft direction; showing the NIR reflectance of this fabric in the range of 600 to 900 nanometers.

FIG. 6 is a graphical representation of the same fabric in FIG. 5 with the exception the fabric is dyed brown. The Example 6 fabric was dyed and dried in the same manner as previously described. FIG. 6 shows the NIR reflectance of this fabric in the range of 600 to 900 nanometers and having 3 distinct reflection curves. These 3 curves give rise to a distinct observable separation among the various regions of the fabric as viewed with a night vision device. The Example 6 fabric region with the no additive yarn in the warp direction and the yarn containing carbon black direction reflect between 4 and 22% over the 600 to 700 nm range, 22%-64% over the 700 nm to 800 nm range and 64-66% over the range 800-860 nm. The yarn containing carbon black in the warp direction and the fiber containing carbon black in the fill direction of Example 6 reflect between 4 and 22% over the 600 to 700 nm range, 22%-50% over the 700 nm to 800 nm range and 50-53% over the range 800-860 nm. The SDN Cordura® COYOTE fiber in the warp direction and the fiber containing carbon black in the fill direction reflect between 4 and 15% over the 600 to 700 nm range, 15%-46% over the 700 nm to 800 nm range and 46-57% over the range 800-860 nm. The Example 6 reflectance curves between 600 and 700 nm are almost identical. The similarities occur due to their VIS color being essentially the same and thus displaying the same reflectance curve. However, beyond 700 nm their reflectance curves separate allowing for a distinct pattern observable using night vision devices.

Example 7 combines all the features of Examples 1, 3, and 5. In this example, Example 7, the warp yarn and fill yarns consist of the 3 polyamide yarns of Table 1: the yarn having no additive, the yarn having carbon black, known as Cordura® EP and the yarns having color pigments, known as SDN Cordura® COYOTE. The visual and NIR reflectance curves were exactly the same as those for the combinations previously described. Effectively, the Example 7 fabric had 9 distinct reflectance patterns in the NIR.

Example 8 is the same fabric as that of Example 7 except the fabric was dyed brown. The Example 8 fabric was dyed and dried in the same manner as previously described. Upon finishing the fabric exhibited a single color in the VIS spectrum and 9 distinct regional reflectance patterns in the NIR region. These reflectance patterns were exactly the same as described for Examples 2, 4 and 6.

Those skilled in the art, having the benefit of the teachings of the present invention as herein and above set forth, may effect modifications thereto. Such modifications are to be construed as lying within the scope of the present invention, as defined by the appended claims.

What is claimed:

1. A fabric having a camouflage appearance in the near infrared (NIR) spectrum and having a uniform appearance in the visible (VIS) spectrum, the fabric comprising at least two types of synthetic polymer multifilament yarns, wherein the at least two types of multifilament yarns are selected from the group consisting of: a first type of multifilaments comprising carbon black in an amount of from about 10 parts per million to about 300 parts per million, a second type of multifilaments comprising pigments which modify a NIR reflectance characteristic of said second type of multifilaments, and a third type of multifilaments substantially free of additives capable of modifying the NIR reflectance characteristics of said third type of multifilaments; and wherein said fabric exhibits a single substantially uniform color appearance in the VIS spectrum of 400-680 nm and further exhibits a patterned appearance in the NIR spectrum of 700-900 nm due to different NIR reflectivities of the component multifilament yarns.

2. The fabric of claim 1 wherein the substantially single color appearance in the visible spectrum is provided by a dye.

3. The fabric of claim 1 wherein the NIR spectrum comprises two reflectance curves having about 10% to about 85% reflectance and wherein the two reflectance curves are separated by about 5% reflectance in a range of wavelengths from about 700 to about 860 nanometers (nm).

4. The fabric of claim 1 wherein the NIR spectrum comprises three reflectance curves having about 25% to about 75% reflectance and wherein the three reflectance curves are separated by about 5% reflectance in a range of wavelengths from about 700 to about 860 nanometers (nm).

5. The fabric of claim 1 comprising a woven fabric having a warp and a fill direction wherein the at least two synthetic polymer multifilament yarns comprise the warp direction and the fill direction.

6. The fabric of claim 1 comprising a knit fabric having a course row of loops and wale column of loops wherein the at least two synthetic polymer multifilament yarns comprise the course row of loops and the wale column of loops.

7. The fabric of claim 1 wherein the at least two synthetic polymer multifilament yarns comprise synthetic polymers selected from the group consisting of: polyamides and polyesters.

8. The fabric of claim 2 wherein the substantially single color appearance in the visible spectrum is provided by a dye applied to the fabric.

9. The fabric of claim 2 wherein the substantially single color appearance in the visible spectrum is provided by a dye applied to the synthetic polymer multifilament yarns prior to fabric formation.

10. The fabric of claim 1 wherein the woven or knitted fabrics according to the invention can be formed from synthetic polymer multifilament yarns comprised of mixtures of such yarns with natural fibers.

11. A method for rendering a camouflage appearance to a fabric in the near infrared (NIR) spectrum while retaining a substantially uniform appearance in the visible (VIS) spectrum, comprising the steps of: providing at least two types of synthetic polymer multifilament yarns selected from the group consisting of: a first type of multifilaments comprising carbon black in an amount of from about 10 parts per million to about 300 parts per million, a second type of multifilaments comprising pigments which modify a NIR reflectance characteristic of said second multifilaments, and a third type of multifilaments substantially free of additives capable of modifying the NIR reflectance characteristics of said third multifilaments; forming a fabric having a predetermined patterned appearance in the NIR spectrum of 700-900 nm provided by the different NIR reflectivities of at least two of said first, second and third multifilament yarn types; and dyeing the fabric to a single substantially uniform color appearance in the VIS spectrum of 400-680 nm.

* * * * *